United States Patent [19]

Küttenbaum et al.

[11] 4,333,297

[45] Jun. 8, 1982

[54] CONVEYOR DEVICE FOR PACKAGING

[75] Inventors: Valentin Küttenbaum, Laupheim; Ernst Henle, Schwendi-Weihungszell, both of Fed. Rep. of Germany

[73] Assignee: Josef Uhlmann Maschinenfabrik GmbH & Co. KG, Laupheim, Fed. Rep. of Germany

[21] Appl. No.: 147,082

[22] Filed: May 7, 1980

[30] Foreign Application Priority Data

Jul. 25, 1979 [DE] Fed. Rep. of Germany ..... 2930150

[51] Int. Cl.[3] ..... B65B 5/00

[52] U.S. Cl. ..... 53/252; 53/258; 198/456; 198/813

[58] Field of Search ..... 198/456, 575, 583, 813; 53/251, 252, 579, 258

[56] References Cited

U.S. PATENT DOCUMENTS

| | | | |
|---|---|---|---|
| 2,631,767 | 3/1953 | Banks | 53/252 |
| 3,333,396 | 8/1967 | Paal et al. | 53/252 |
| 3,906,705 | 9/1975 | Beck et al. | 53/252 |
| 4,007,827 | 2/1977 | Mattos | 198/813 |

*Primary Examiner*—W. D. Bray
*Attorney, Agent, or Firm*—Karl F. Ross

[57] ABSTRACT

A packaging device comprises three conveyor assemblies, each having a belt mounted on wheels in turn rotatably attached to a carrier disposed within a loop formed by the respective belt. The carriers have apertures for being removably secured by screws to a vertical plate of a supporting frame, while the wheels include respective shafts with couplings for forming a locked driving engagement between drafts upon assemblage of the packaging device, the rotation of one wheel by a power source thus serving to drive all of the belts. A first pair of assemblies transport goods and containers along parallel paths from respective feeders and a third assembly carries reciprocating pushers along a third parallel path for loading the goods into the containers. A carrier is formed from a pair of members slidably interconnected for increasing the distance between peripherally mounted belt-bearing wheels and thereby increasing belt tension.

9 Claims, 7 Drawing Figures

CONVEYOR DEVICE FOR PACKAGING

FIELD OF THE INVENTION

Our present invention relates to a conveyor. More particularly, our present invention relates to a conveyor device for the packaging of goods.

BACKGROUND OF THE INVENTION

In the packaging field, it is customary to have at least two endless-belt conveyors in which the belts run along parallel paths for at least a portion of their respective lengths, goods being transferred from one belt to the other during negotiation of the parallel paths. Frequently the transfer is implemented by means of pushers on a third conveyor having a belt moving along a path parallel in part to the paths of the first two conveyors.

The pushers are actuated to move goods from one belt to containers or receptacles on another belt.

Known conveyor packing devices have a main drive shaft extending from a rotary-power source. Conveyor belts which are to move at the same speed have respective belt-bearing or belt-deflecting wheels mounted on the main shaft, while belts which are to move at different speeds are operatively connected to the main shaft via auxiliary shafts and speed-changing transmission trains. The particular forms of the conveyor belts depends on the nature of the goods and the packaging containers, a commonly used belt being formed from slat members attached to endless chains which mesh with teeth on the bearing wheels.

A major disadvantage to these known devices is the difficulty of repair and maintenance. In order to replace a malfunctioning such as an inner bearing wheel on the main shaft, at least two belts must be dismantled and their respective driving wheels removed from the main shaft. The replacement of the malfunctioning wheel thus requires a great amount of time, during which the conveyor device is inoperative. Because many of the machine parts may be disposed within the device, i.e. at inaccessible locations, even routine maintenance operations may reduce the effective use and raise the operating costs of the device.

OBJECT OF THE INVENTION

The object of our present invention is to provide a packaging conveyor of the above-mentioned type, in which accessibility to parts is increased and repair and maintenance times reduced.

SUMMARY OF THE INVENTION

A packaging device according to our present invention comprises a first conveyor assembly mounted on a frame for transporting packagable goods from a product-feed station along a first path extending therefrom. A second conveyor assembly on the frame transports containers from a receptacle-feed station along a second path extending at least in part parallel to the first path. Each assembly includes a conveyor belt mounted on at least two wheels or rollers rigid with or operatively connected to respective shafts rotatably journaled on a carrier disposed within a loop formed by the conveyor belt. Shafts of the assemblies are provided with connectors or couplings whereby a shaft of the first assembly is drivingly interlocked with a shaft of the second assembly. The carriers are removably secured to the frame. A feeder is provided for delivering goods to the product-feed station and containers to the receptacle-feed station, while a drive on the frame is connectable to at least one of the wheel members for supplying rotary power to move the conveyor belts along their respective paths. A loader or transport mechanism on the frame operates in synchronism with the conveyor belts to move goods from the first assembly to containers on the second assembly substantially transversely to the conveyor paths at the parallel portions thereof.

According to another feature of our present invention, the loader includes at least one reciprocating element for pushing the goods from the first assembly's belt to containers on the second assembly, the element being mounted on a third conveyor assembly on the frame for motion along a third path extending parallel to the first two paths at the parallel portions thereof. The third assembly is similar in construction to the other two and includes an additional conveyor belt mounted on at least two additional wheels rigid with respective additional shafts, these shafts being journaled on an additional carrier disposed substantially within a loop defined by the third conveyor belt. At least one of the additional shafts is provided with a connector or coupling element for drivably interlocking with a shaft of one of the first and second assemblies. The additional carrier is removably secured to the frame.

According to another feature of our present invention, a carrier is advantageously formed as a pair of rigid carrier members having respective free ends in which respective belt-engaging wheels are rotatably mounted, the carrier members being slidably interconnected at ends opposite the wheel-bearing ends for changing the distance between the wheels, whereby the tension of the respective conveyor belt is adjusted.

An advantage of our present invention lies in the modular form of the conveyor assemblies. A device which has suffered a malfunction or breakdown may be quickly and easily restored to an operative condition by the replacement of the assembly in which the malfunction is located. Such a malfunctioning assembly may then be returned to the manufacturer for repairs. Practically any number of assemblies may be juxtaposed on the frame in whatever arrangement is preferable for a given purpose.

According to further, more particular, features of our present invention, a brace journaled in one of the members of a carrier has an eccentric brace portion or extension traversing the other carrier member for forcibly shifting these members relative to one another.

A lock is provided for preventing relative rotation of the carrier members, while a clamp prevents longitudinal slippage, i.e. motion in the direction of the sliding interconnection of the carrier members. Guards on the carriers guide the conveyor belts. The frame includes threaded bores and the carriers are provided with apertures alignable with the bores, whereby the carriers are secured to the frame by means of screws.

The couplings on the shafts advantageously comprise plug connections which automatically interlock or disengage upon the attachment or removal of a conveyor assembly from the frame. Thus, assembly, repair and maintenance operations are facilitated. If the particular use requires belts of different speeds, transmissions mounted on respective carriers may be inserted between the driving shafts of adjacent conveyors. Alternatively, speed-changing power trains may be mounted on carriers of the various belts.

BRIEF DESCRIPTION OF THE DRAWING

These and other features of our present invention will now be described in detail, reference being made to the accompanying drawing in which.

SPECIFIC DESCRIPTION

Figure 1:
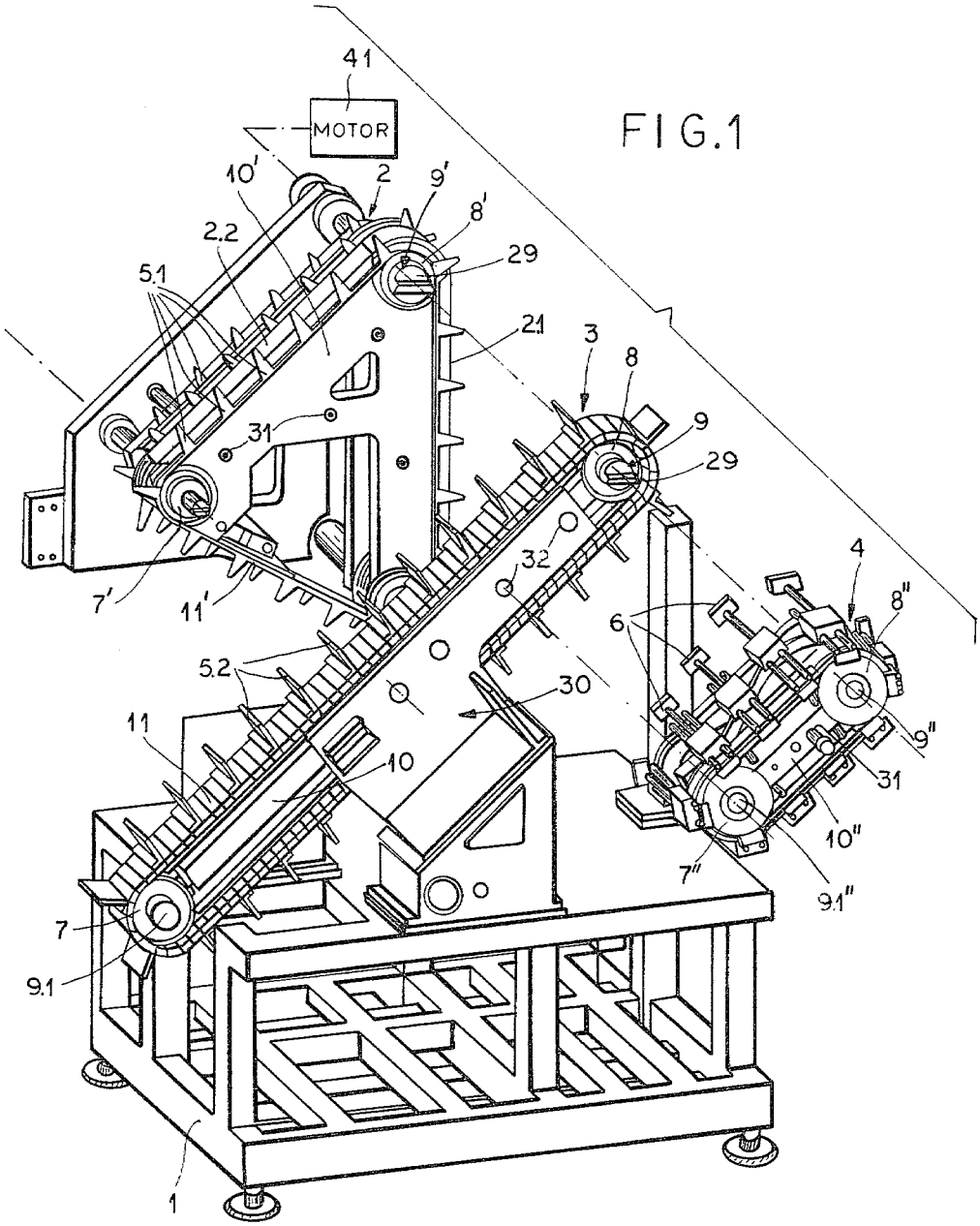
FIG. 1 is an exploded perspective view of a packaging device according to our present invention, showing three conveyor assemblies securable to a frame.
Figure 6:
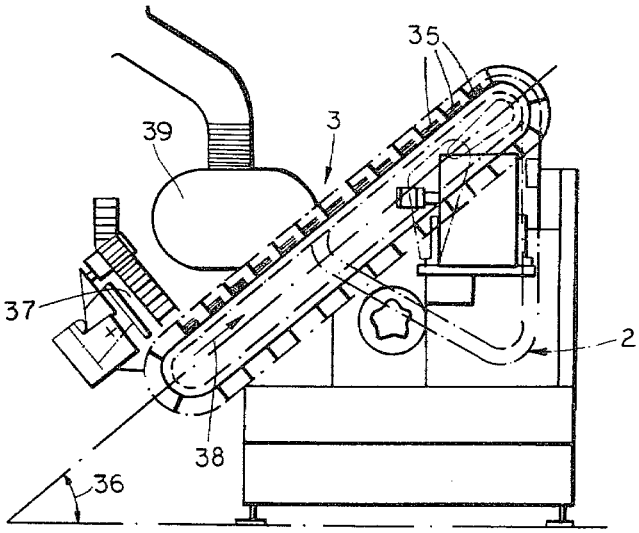
FIG. 6 is a schematic elevational view of the device of FIG. 1, also showing a pair of feeders.
Figure 7:
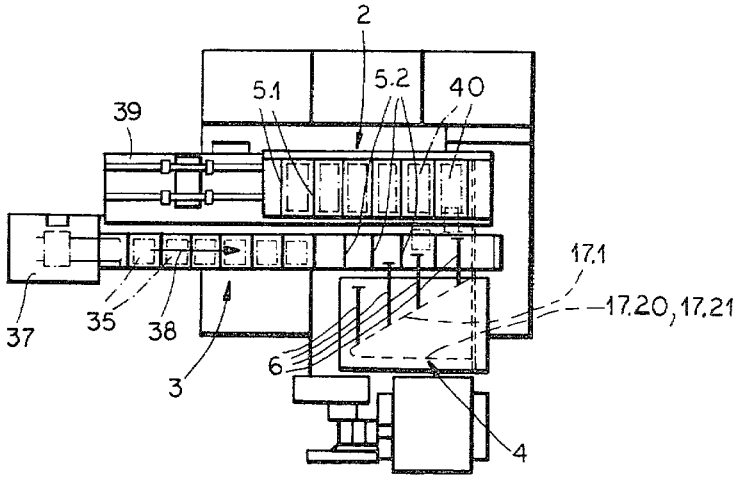
FIG. 7 is a schematic plan view corresponding to FIG. 6.

As shown in FIGS. 1, 6 and 7, a device for packaging goods comprises, according to our present invention, a first conveyor assembly 3 for transporting fixed amounts of packagable material 35 (FIG. 6) along a linear path 38 extending from a feeder 37 at an angle 36 with respect to the horizontal, this angle being of a magnitude sufficient to ensure the sliding of goods 35 down along a conveyor belt 11 until stopped by arrests or compartment dividers 5.2. Belt 11 is mounted for motion on a pair of rollers or wheels 7, 8 in turn rotatably mounted on a carrier 10 via respective shaft stumps 9.1, 9. Conveyor assembly 3, including wheels 7, 8, shafts 9, 9.1, carrier 10 and belt 11, is removably secured to a vertical plate 30 of a frame 1.

A second conveyor assembly 2 for transporting packaging containers 40 from a receptacle feeder 39 has a multiplicity of fingers 5.1 extending substantially perpendicularly to a sliding surface 2.2 and to a guide surface 2.1 which are disposed in a plane parallel to the plane of path 38 and in an approximately vertical plane, respectively. Upon being deposited on surface 2.2, containers 40 are pushed therealong by fingers 5.1 at the same rate and with the same separation that goods 35 move along path 38, goods 35 being pushed into containers 40 by loading members 6 included in a third conveyor assembly 4. Loading members 6 are attached to a conveyor belt 11'' for reciprocation transverse to path 38 and for motion parallel thereto in synchronism with the dividers 5.2 of assembly 3 and the fingers 5.1 of assembly 2.

Each assembly 2, 3, 4 is formed as a quasimodular unit having a conveyor belt 11', 11, 11'' mounted on respective wheels or rollers 7', 7, 7'' and 8', 8, 8'' in turn rotatably connected by means of shafts 9.1', 9.1, 9.1'' and 9', 9, 9'' to carriers 10', 10, 10''. These carriers 10', 10, 10'' are provided with openings or apertures 31', 31, 31'' alignable with bores 32 in plate 30 for removably securing assemblies 2, 3, 4 to frame 1 via screws (not shown). The belts 11', 11, 11'' of assemblies 2, 3, 4 are driven by a motor 41 operatively connected to a shaft of one of the assemblies, e.g. shaft 9', rotary power being transmitted from shaft 9' to shafts 9 and 9'' by means of couplings 29 form advantageously as interlocking projections and slots on the ends of shafts 9, 9', 9''. The slots and projections lockingly engage one another upon the alignment and fitting of assemblies 2, 3, 4 onto plate 30.

Figure 2:
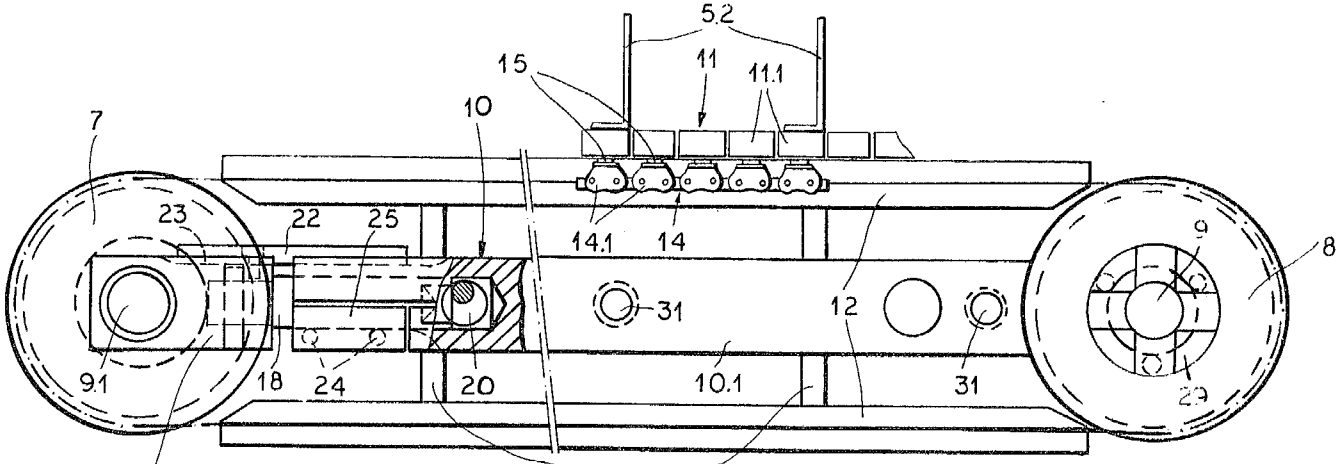
FIG. 2 is a partially schematic, partially broken-away side view of an assembly shown in FIG. 1.
Figure 3:
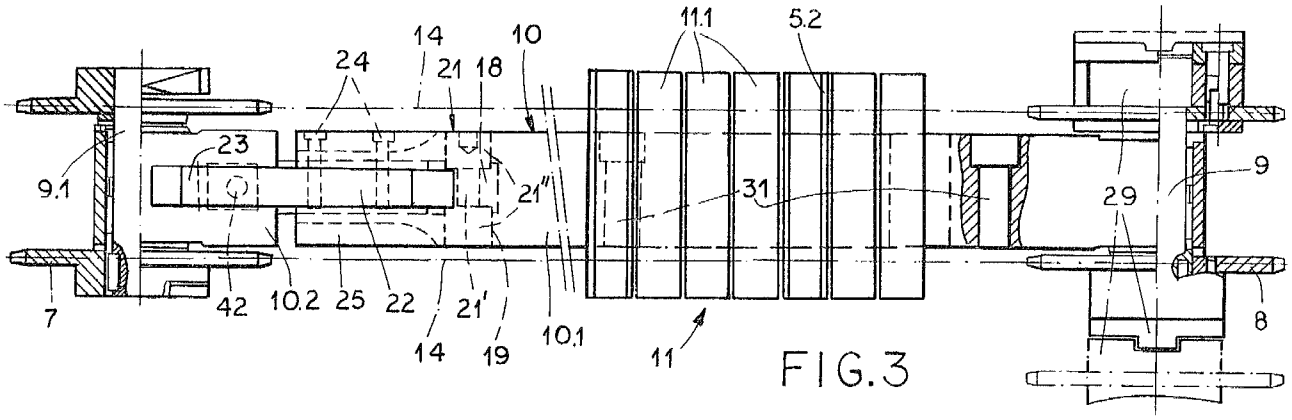
FIG. 3 is a partially schematic, partially broken-away top view of the assembly shown in FIG. 2.

As shown in FIGS. 2 and 3, carrier 10 comprises a pair of members 10.1 and 10.2 slidably joined for increasing the distance between wheels 7 and 8 and hence the tension of belt 11. A rod or cylindrical bar 18 rigid with member 10.2 is matingly received into a similarly shaped bore in member 10.2 and has an opening 20 traversed by an eccentric middle portion 21' of a bracing shaft 21 whose outer portions 21'' are journaled in a bore 19' formed in member 10.1. Eccentric shaft portion 21' engages a surface of opening 20 so that a rotation of shaft 21 forces rod 18 to withdraw a predetermined amount from carrier member 10.1. In order to lock members 10.1 and 10.2 to one another, member 10.1 is provided with a clamp consisting of a split collar 25 and a pair of tightening bolts 24; upon the setting of the tension in belt 11 via the turning of shaft 21, bolts 24 are screwed in to clamp collar 25 to rod 18. Relative rotational motion or twisting between carrier members 10.1, 10.2 is prevented by an elongate bar 22 of rectangular cross-section seated in a pair of grooves or recesses 23 in these members and fixed to member 10.2 by a screw 42.

As best seen in FIG. 2, belt 11 may be formed from elongate sections or slats 11.1 attached via connectors 15 to respective links 14.1 of a pair of endless chains 14 intermeshing with teeth of wheels 7 and 8. Guards or guides 12 for stabilizing chains 14 in a transverse direction are fixed to carrier member 10.1 by means of braces or spacers 13. Dividers or arrests 5.2 are attached to respective slats 11.1 of belt 11.

Figure 4:
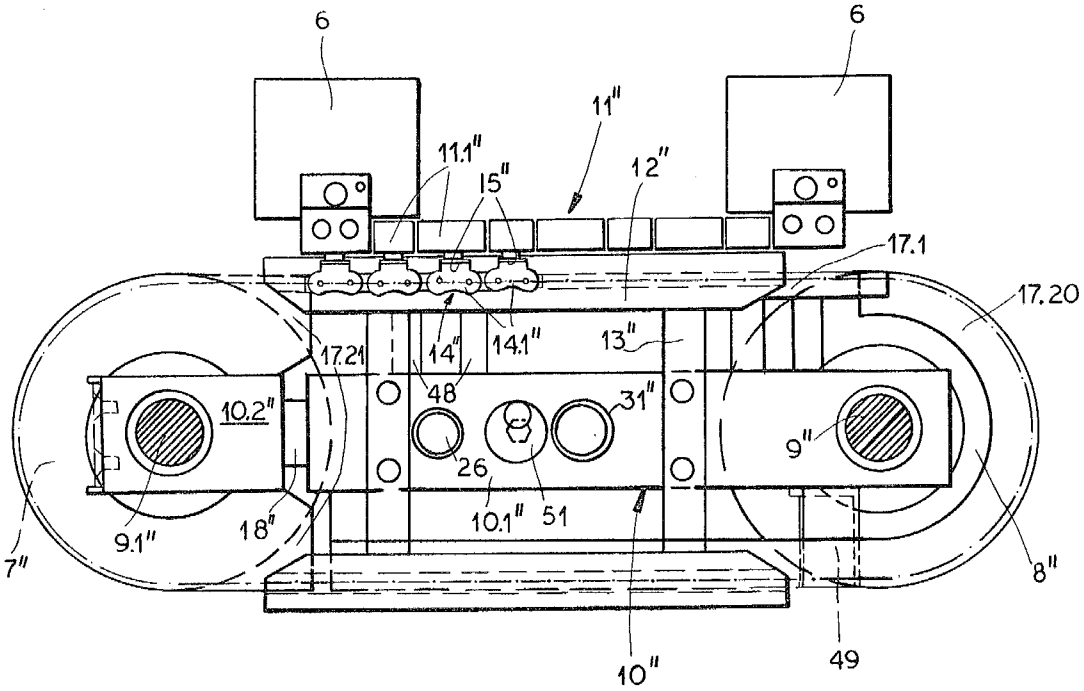
FIG. 4 is a view similar to FIG. 2 of another assembly shown in FIG. 1.
Figure 5:
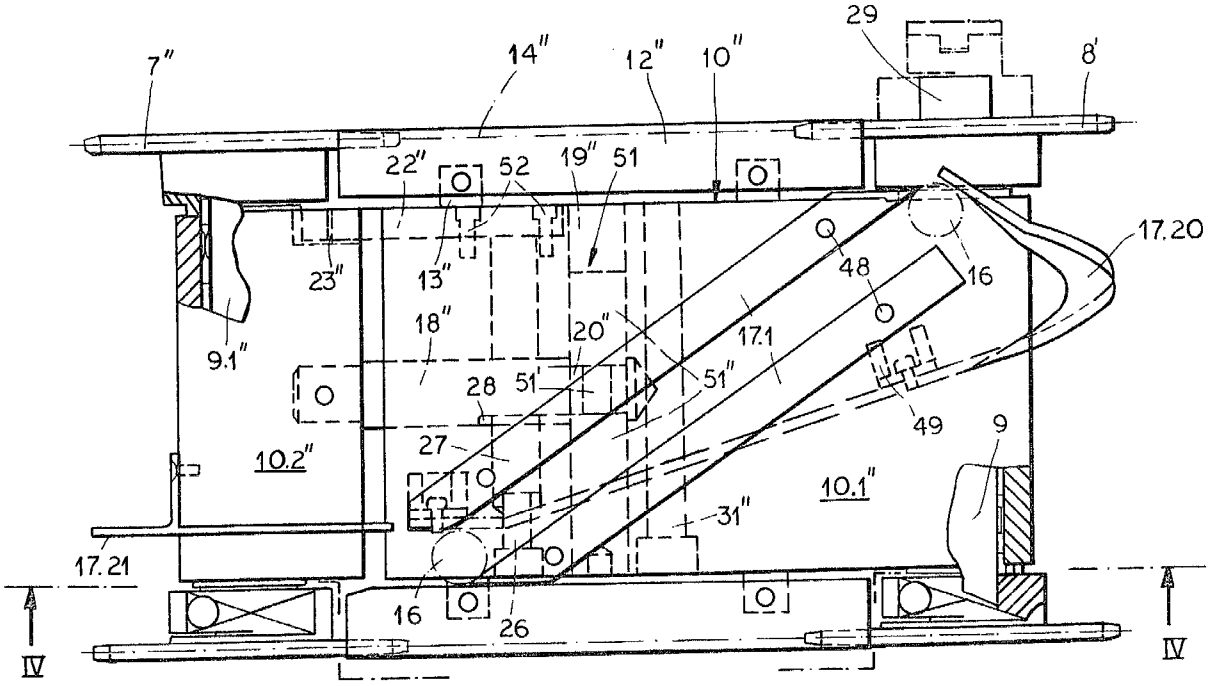
FIG. 5 is a view similar to FIG. 3 of the assembly shown in FIG. 4.

As shown in FIGS. 4 and 5, assembly 4 also has a carrier 10'' including a pair of members 10.1'', 10.2'' adjustably interconnected by a rod 18'' rigidly secured to member 10.2'' and slidably inserted in a bore in member 10.1''. A shaft 51 with peripheral portions 51'' journaled in a bore 19'' in member 10.1'' and an eccentric middle portion 51' traversing a substantially cylindrical aperture 20'' in rod 18'' cofunctions therewith to increase the separation of sprocket wheels 7'' and 8'' which are mounted at the free ends of members 10.2'' and 10.1'', respectively. Thus, the tension of conveyor belt 11'' may be adjusted upon the attachment of assembly 4 to frame plate 30.

For inhibiting twisting between members 10.1'' and 10.2'', a bar 22'' is fastened by two screws 52 to carrier member 10.1'' and is seated in a recess 23'' of similar cross-section in carrier member 10.2''. Upon the setting of the belt tension, carrier members 10.1'', 10.2'' are locked to one another by means of a screw 26 which forces a friction element or block 27 against rod 18'' in a recess 27 thereof.

Loaders or pushers 6 are mounted on respective conveyor-belt slats 11.1'' which in turn are secured via connectors 15'' to respective links 14.1'' of a pair of endless chains 14'' meshing with sprocket wheels 7'' and 8''. Pushers 6 are provided with actuation arms 16 (see FIG. 5) which engages a cam 17.1 for extending the pushers during motion of the associated belt 11.1'' in the direction of path 38 (see similarly designated arrow in FIGS. 6 and 7). A pair of return cams 17.20 and 17.21 engage the arms 16 upon completion of a loading stroke to retract the pushers 6 in preparation for another loading stroke. Cam 17.1 is formed as two parallel guides attached to carrier member 10.1'' by brackets or spacers 48. Cam 17.20 is fixed to member 10.1'' by braces 49 and spirals around shaft 9''; cam 17.21 is essentially a circular barrier or guide attached to carrier member 10.2''.

Upon the filling of containers 40, arms 5.1 push the same from sliding surface 2.2 around wheel 8' and onto guide surface 2.1. During motion along surface 2.1 under the restraining action of arms 5.1, containers 40 are closed, or example, by the attachment of lids or by the folding of end flaps.

Containers 40 may take the form of boxes, receptacle feeder 39 constituting a box erector such as that described in commonly owned copending U.S. patent application Ser. No. 134,795, Ser. No. 134,796 (now abandoned) and Ser. No. 134,987, all filed Aug. 28, 1980. If goods 35 are stackable, feeder 37 preferably has a form described in commonly owned copending applications Ser. Nos. 147,482 and 147,082 both filed May 7, 1980 (both now abandoned) by V. Küttenbaum, E. Henle, and H. Anschaber.

We claim:

1. A packaging device comprising:

a frame;

a first conveyor assembly on said frame for transporting packagable goods from a product-feed station along a first path extending therefrom;

a second conveyor assembly on said frame for transporting containers from a receptacle-feed station along a second path extending at least in part parallel to said first path, said assemblies each including a conveyor belt mounted on at least two wheel members rigid with respective shafts rotatably journaled on a carrier disposed within a loop formed by said belt, each of said assemblies being provided with at least one shaft formed with connector means whereby a shaft of said first assembly is drivably interlocked with a shaft of said second assembly, the carriers of said assemblies being removably secured to said frame;

feed means for delivering said goods to said product-feed station and said containers to said receptacle-feed station;

drive means on said frame connectable to at least one of said wheel members for supplying rotary power to move the belts of said first and said second assemblies along said first and said second paths, respectively; and transport means on said frame operating in synchronism with the belts of said assemblies to move goods from said first assembly to containers on said second assembly substantially transversely to said paths at parallel portions thereof.

2. The device defined in claim 1 wherein said transport means includes at least one reciprocating element for pushing said goods from said first assembly to containers on said second assembly, said element being mounted on a third conveyor assembly on said frame for motion along a third path extending at least in part parallel to said first path and said second path at the parallel portions thereof.

3. The device defined in claim 2 wherein said third assembly includes an additional conveyor belt mounted on at least two additional wheel members rigid with respective additional shafts rotatably journaled on an additional carrier disposed within a loop formed by said additional conveyor belt, at least one of said additional shafts being provided with connector means for drivably interlocking with a respective shaft of one of said first and second assemblies, said additional carrier being removably secured to said frame.

4. The device defined in claim 1, 2 or 3 wherein the carrier of at least one of said assemblies includes a pair of rigid carrier members having respective free ends in which respective belt-engaging wheels are rotatably mounted, said carrier members being slidably interconnected at ends opposite said free ends for changing the distance between said belt-engaging wheels, whereby the tension of the respective conveyor belt is adjusted.

5. The device defined in claim 4 wherein said one of said assemblies includes a shaft journaled in one of said carrier members formed with an eccentric extension traversing the other carrier member for forcibly shifting said carrier members longitudinally with respect to one another.

6. The device defined in claim 5, further comprising locking means engaging said carrier members for preventing relative rotation thereof.

7. The device defined in claim 5, further comprising clamping means on said carrier members for preventing longitudinal slippage thereof relative to one another.

8. The device defined in claim 1, 2 or 3, further comprising guides on the carriers of said assemblies for guiding the belts thereof.

9. The device defined in claim 1, 2 or 3, wherein said frame includes a plate with bores and the carriers of said assemblies are provided with apertures whereby the carriers are secured to said plate by means of screws.

* * * * *